US007637750B1

(12) United States Patent
Polnyi

(10) Patent No.: US 7,637,750 B1
(45) Date of Patent: Dec. 29, 2009

(54) ELECTRICAL CONNECTOR SYSTEM WITH PROTECTIVE PLATE

(75) Inventor: Igor Polnyi, Aurora, IL (US)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 12/220,217

(22) Filed: Jul. 22, 2008

(51) Int. Cl.
*H01R 12/00* (2006.01)

(52) U.S. Cl. ..... 439/66; 439/71

(58) Field of Classification Search ..... 439/66, 439/70, 71, 591, 862
See application file for complete search history.

(56) References Cited

U.S. PATENT DOCUMENTS 5,247,250 A * 9/1993 Rios ..... 324/754
5,248,262 A * 9/1993 Busacco et al. ..... 439/66
6,749,441 B1 * 6/2004 Ma ..... 439/66
7,021,942 B2 * 4/2006 Grant et al. ..... 439/66
7,044,746 B2 5/2006 Copper et al.

* cited by examiner

*Primary Examiner*—Thanh-Tam T Le
(74) *Attorney, Agent, or Firm*—Andrew C. Cheng; Wei Te Chung; Ming Chieh Chang

(57) ABSTRACT

The present invention provides an electrical connector system for establishing electrical connection between an IC package (e.g. CPU) and a PCB. The electrical connector system comprises a base having opposing perimeter walls extending upwardly from peripheral edges of said base, a plurality of contacts and a protective plate. The perimeter walls provide a substantially continuous contact-receiving surface between said perimeter walls and the perimeter walls define a cavity therebetween above the contact-receiving surface. The plurality of contacts is arranged on the contact receiving-surface, and each including a contact engaging portion extending above the contact-receiving surface. The protective plate is floatably arranged on the perimeter walls of the base and substantially above the contact engaging portions and has a plurality of holes correlated to the contact engaging portions such that the contact engaging portion can extend through the hole when the plate is pushed toward the base.

11 Claims, 19 Drawing Sheets

ELECTRICAL CONNECTOR SYSTEM WITH PROTECTIVE PLATE

BACKGROUND OF THE INVENTION

1. Field of the Invention

The present invention relates to the art of electrical connectors. In detail, the present invention relates to a central processing unit (CPU) socket, and more particularly to a socket that has a protective cover to keep forces generated during CPU installation in the CPU socket from damaging the socket contacts.

2. Background of the Invention

CPU sockets are widely used for establishing electrical connection between CPU and a printed circuit board (PCB)/motherboard. Therefore, CPU sockets are mounted on motherboards and hold CPUs execution of programs.

Several types of CPU sockets are available with different structures. For example, a Land Grid Array (LGA) socket, which is found in U.S. Pat. No. 7,044,746 issued to Cooper on May 16, 2006. A typical LGA socket generally has an insulative housing embedded with a number of contacts. The insulative housing of a LGA socket generally has an upper surface for mating with the CPU and arms of the number of contacts are beyond the upper surface. However, the arms of the number of contacts will be bended or damaged by factors such as rough handling or accidental impact, which will weaken even destroy, the electrical connection between the CPU and the LGA socket.

Moreover, LGA sockets, e.g. an LGA 775 that is used to hold the P4 CPU designed by Intel Corp.® are damaged easily or deformed permanently when the CPU is mounted in the socket with excessive force.

In view of foregoing, a new electrical connector system is needed to overcome the above-mentioned shortcomings.

SUMMARY OF THE INVENTION

Accordingly, an object of the present invention is to provide an electrical connector system that has a protective covert to protect a number of contacts received in the connector.

To achieve the above-mentioned object, in a preferred embodiment of the present invention, the present invention provides an electrical connector system for establishing electrical connection between an IC package (e.g. CPU) and a PCB. The electrical connector system comprises a base having opposing perimeter walls extending upwardly from peripheral edges of said base, a plurality of contacts and a protective plate. The perimeter walls provide a substantially continuous contact-receiving surface between said perimeter walls and the perimeter walls define a cavity therebetween above the contact-receiving surface. The plurality of contacts is arranged on the contact receiving-surface, and each including a contact engaging portion extending beyond the contact-receiving surface. The protective plate is floatably arranged on the perimeter walls of the base and substantially above the contact engaging portions and has a plurality of holes correlated to the contact engaging portions such that the contact engaging portion can extend through the hole when the plate is pushed toward the base. By manner above-mentioned, the contacts will avoid being damaged when an IC package is mounted in the electrical connector system with excessive force.

Other objects, advantages and novel features of the present invention will become more apparent from the following detailed description when taken in conjunction with the accompanying drawings.

DETAILED DESCRIPTION OF THE PREFERRED EMBODIMENT OF THE INVENTION

Figure 1:
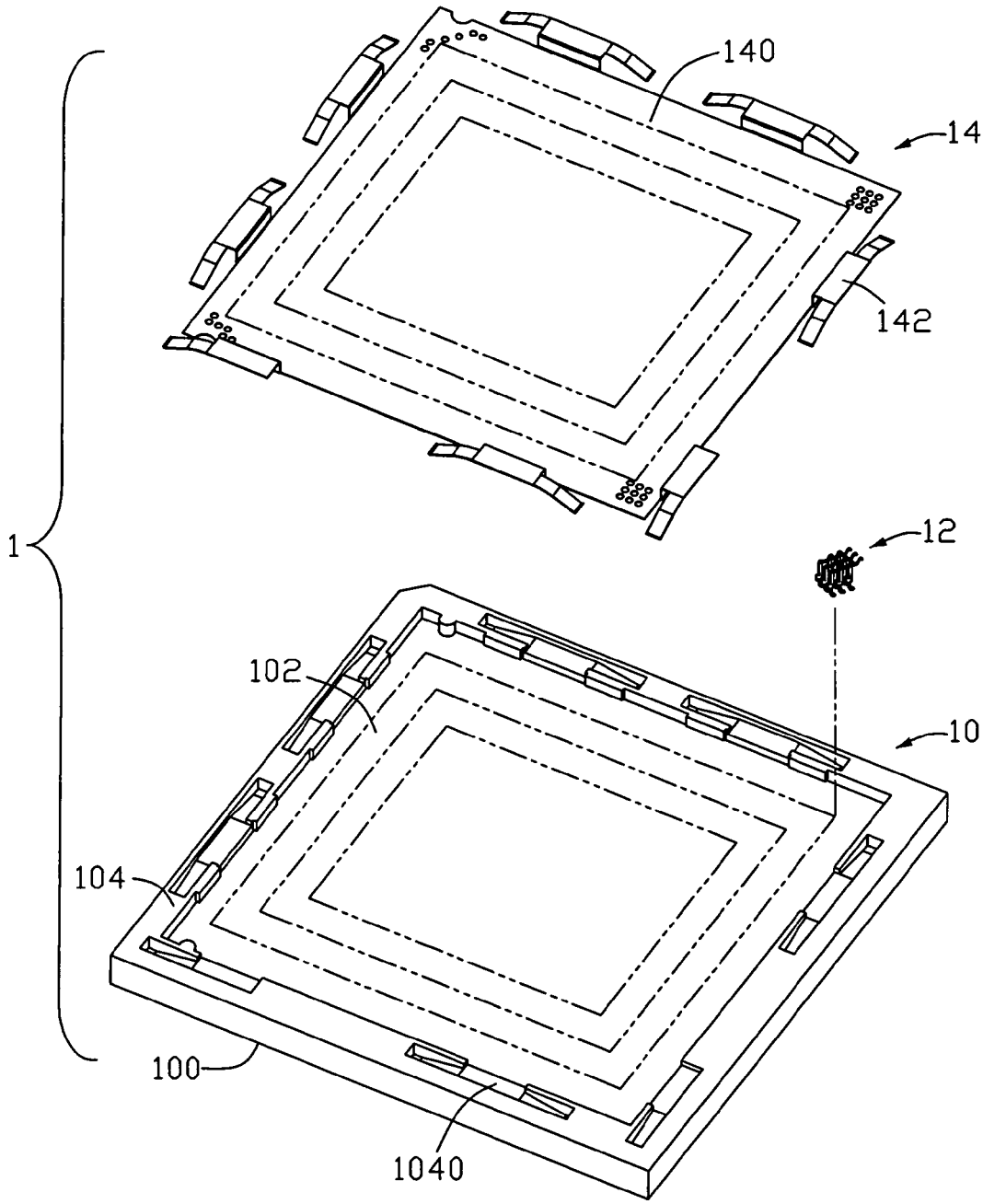
FIG. 1 is an exploded perspective view of an electrical connector system in accordance with a preferred embodiment of the present invention.
Figure 2:
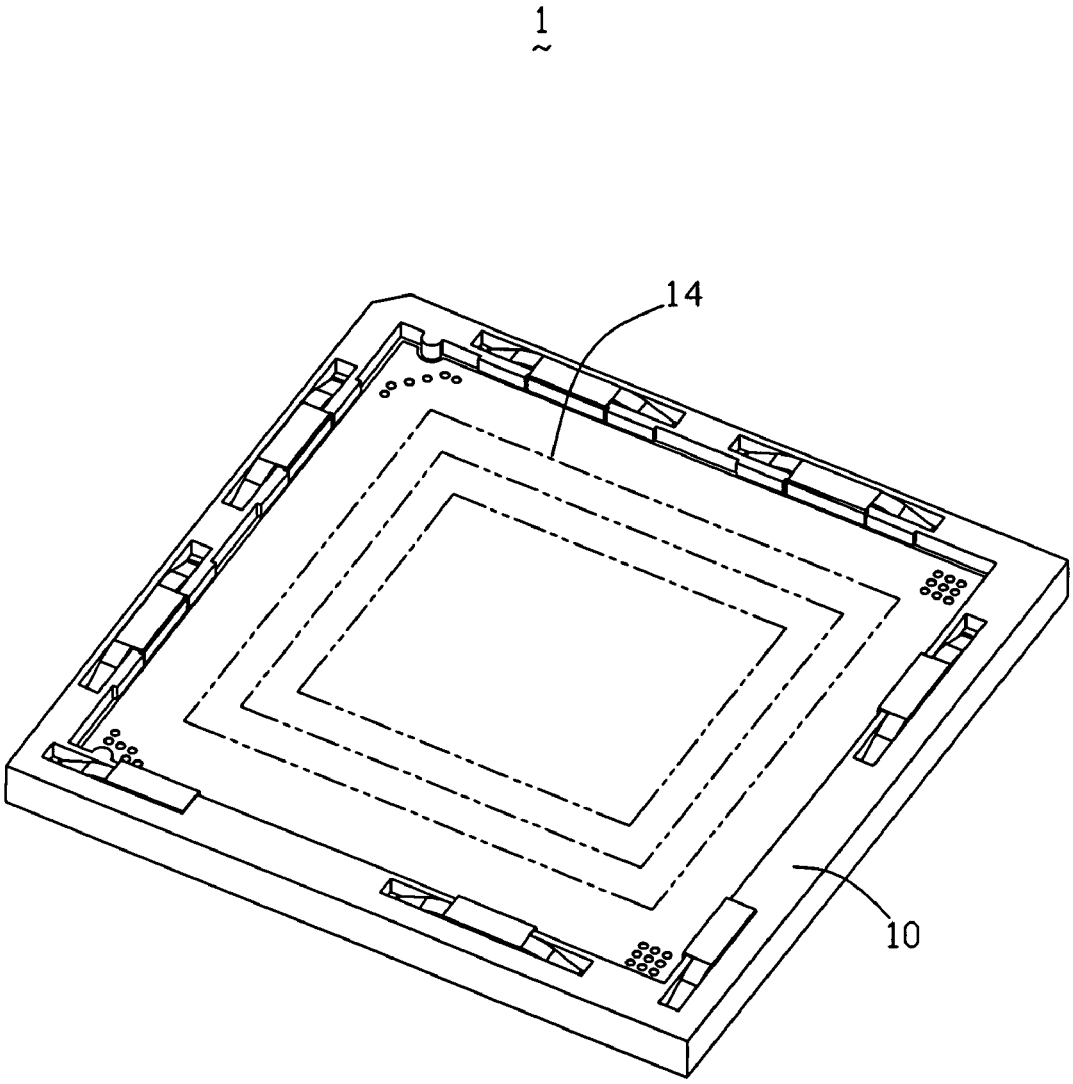
FIG. 2 is an assembled view of the electrical connector system of FIG. 1.
Figure 3:
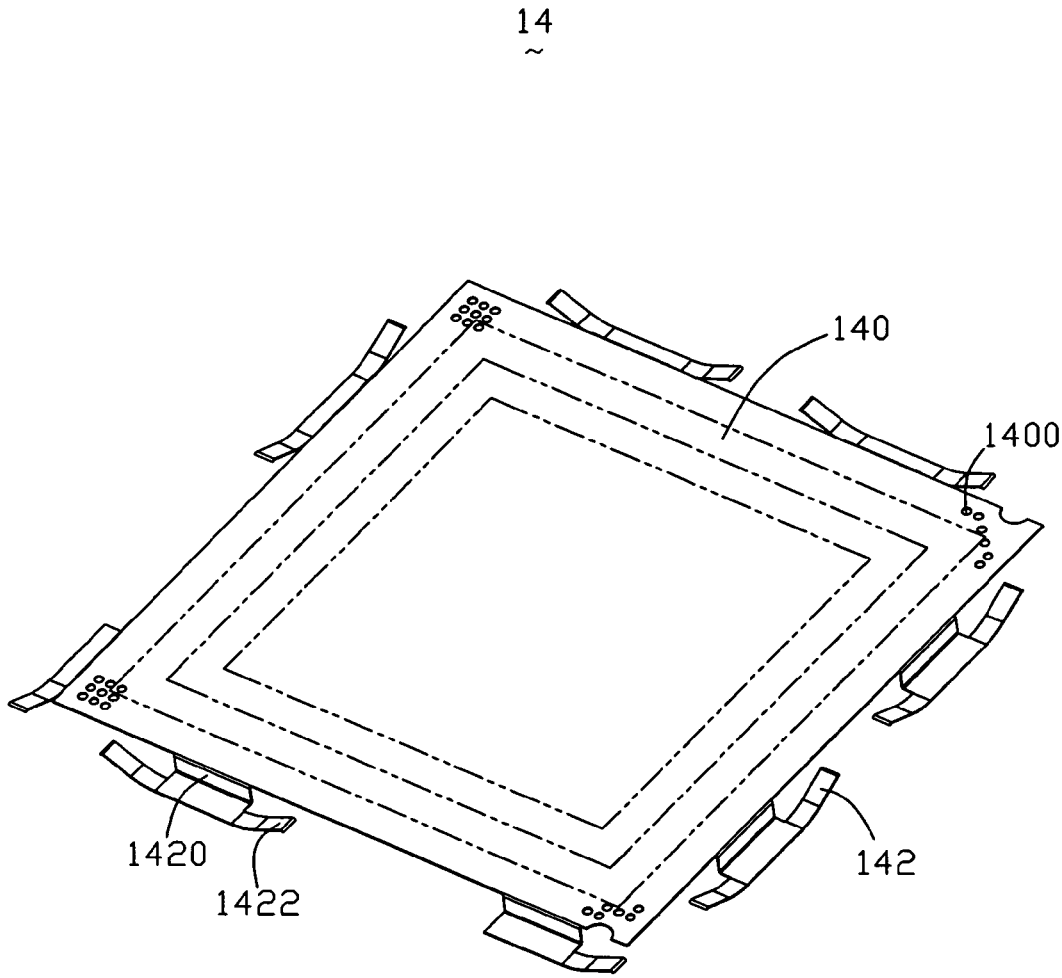
FIG. 3 is a perspective view of the protective plate according the present invention.
Figure 4:
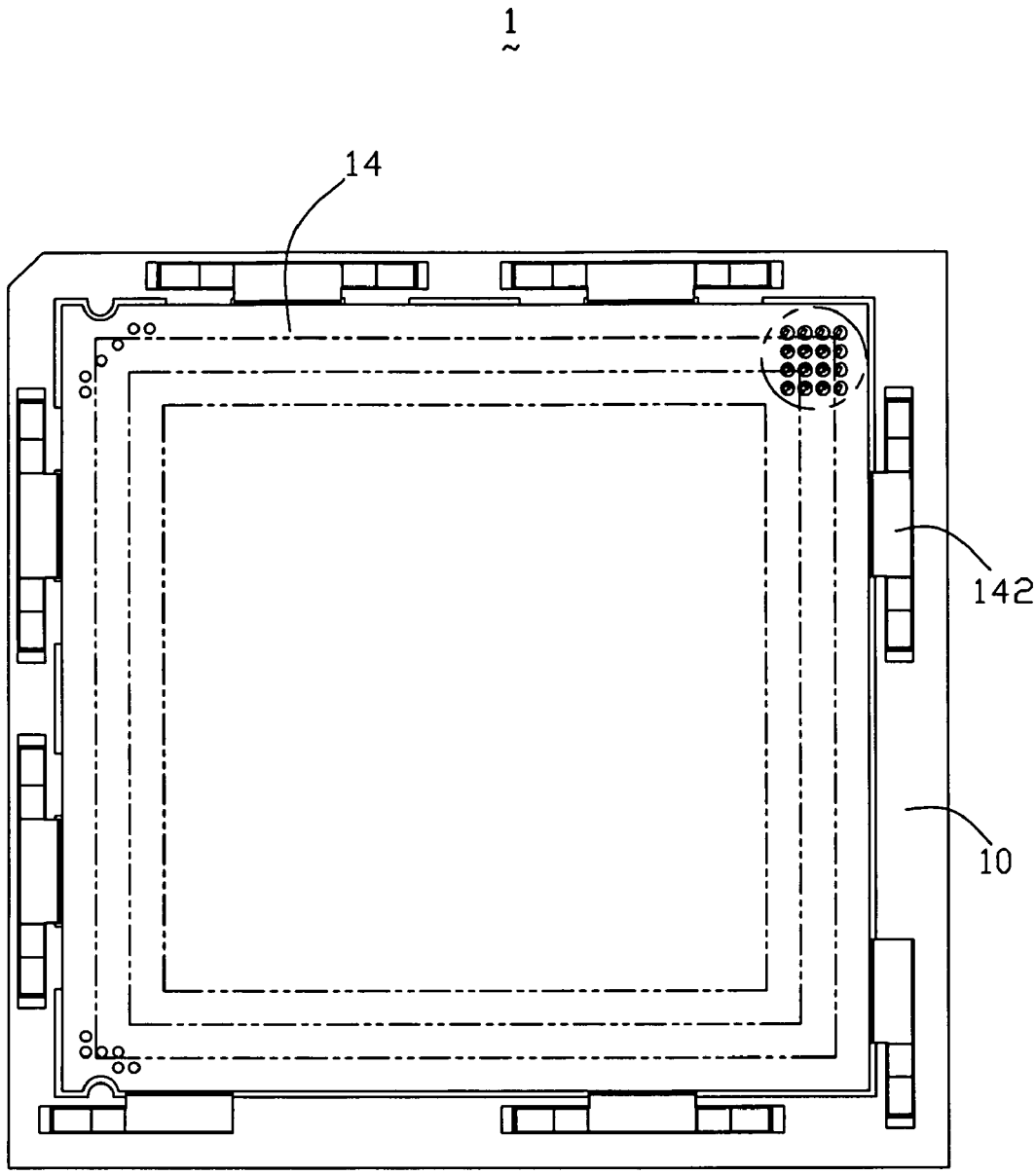
FIG. 4 is a plan view of FIG. 2.
Figure 5:
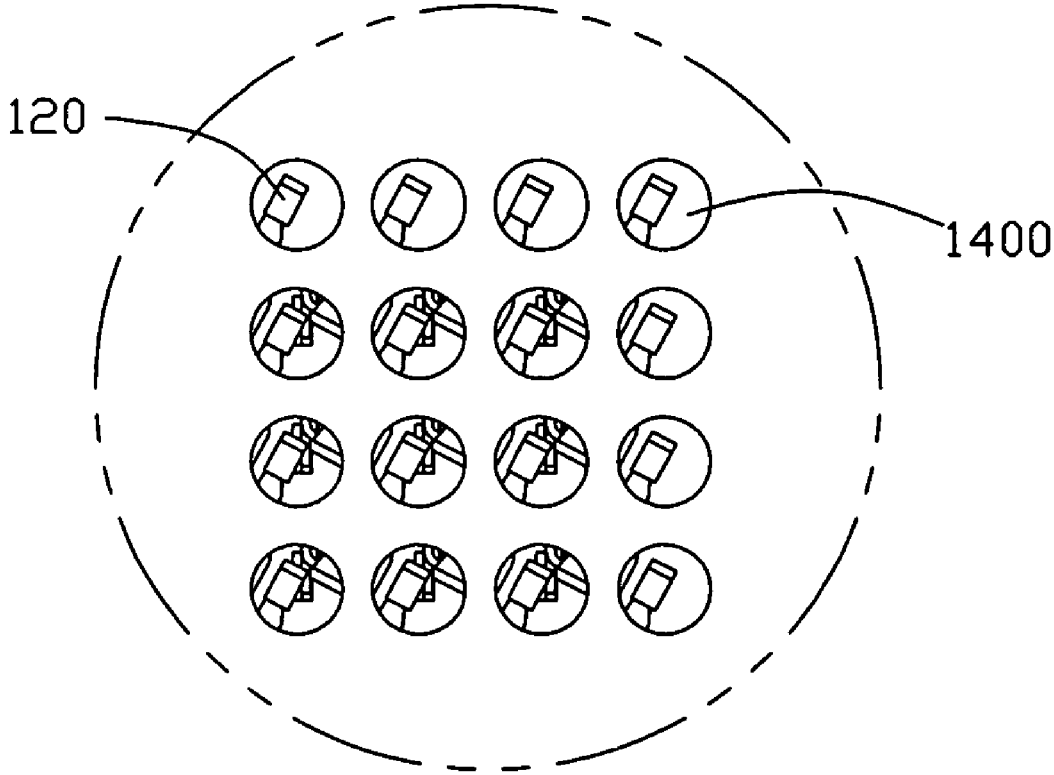
FIG. 5 is an enlarged perspective view of circled portion X shown in FIG. 4.

Reference will now be made to accompany drawings to describe the present invention in detail.

Referring to FIGS. 1-7, according to a first preferred embodiment of the present invention, the electrical connector system 1 comprises a base 10, a plurality of contacts 12 received in the base 10 and a protective plate 14 floatably arranged on the base 10.

The base 10 has a mounting surface 100, a mating surface 102, and a plurality of passageways (not labeled) extending between the mating surface 102 and the mounting surface 100. The base 10 also has opposing perimeter walls 104 extending upwardly from peripheral edges of said base 10, and provides a substantially continuous contact-receiving surface between said perimeter walls 104. The perimeter walls 104 define a cavity (not labeled) therebetween above the contact-receiving surface. In another word, the continuous contact-receiving surface is entirely located in the mating surface 102.

The plurality of contacts 12 is arranged on the contact-receiving surface, and each is received in a passageway. Each of the contacts 12 includes an upper contact engaging portion 120 extending beyond the mating surface 102 and a lower contact engaging portion 122 extending out of the mounting surface 100.

The protective plate 14 comprises a body portion 140 for substantially covering the upper contact engaging portions 120, and a plurality of flexible tabs 142 disposed on the body portion 140. The flexible tabs 142 are elevated higher than a lower surface of the body portion 140, which is also a main surface of the protective plate 14.

The flexible tabs 142 are located in each side of the body portion 140. Each side of the body portion 140 defines two flexible tabs 142. Each of the flexible tabs 142 includes a main portion 1420 connecting with the body portion 140 and two spring legs 1422 extending from opposite sides of the main portion 1420.

In this preferred embodiment, each of the perimeter walls 104 defines two recesses 1040 for accommodating a flexible tab 142 respectively. When the protective plate 14 is assembled to the base 10, the body portion 140 is substantially above the upper contact engaging portions 120, and the plurality of the flexible tabs 142 are received in the recesses 1040 and floating relative to the base 10 because of the spring legs 1422 standing on a bottom of the recesses 1040 of the perimeter walls 104. The body portion 140 defines a plurality of through holes 1400 correlated to the upper contact engaging portions 120.

Moreover, the protective plate 14 is formed from metal material integrally. Specially, the protective plate 14 may be covered by an electrically insulated layer to prevent shorting between contacts 12 and protective plate 14, e.g. protective plate 14 has an insulating coat overall thereof or around the holes 1400 only. It certainly may be formed from other manners, which will be described in detail in other preferred embodiment.

Figure 6:
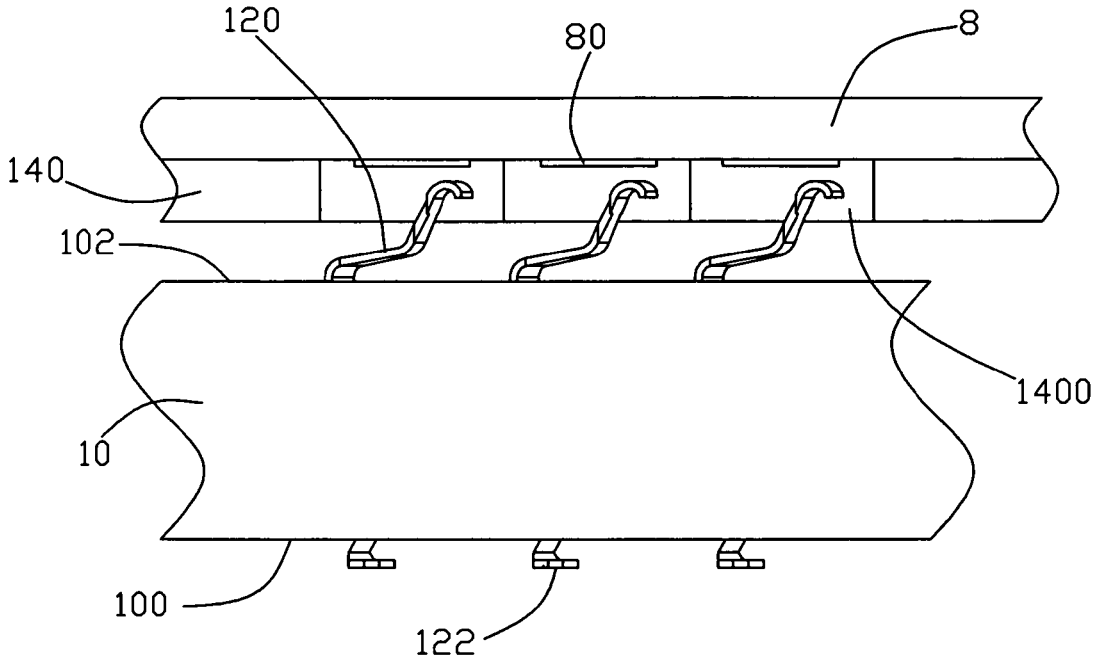
FIG. 6 is a side sketch view of the electrical connector system; especially an IC package is mounted upon the protective plate without pushed toward the base.
Figure 7:
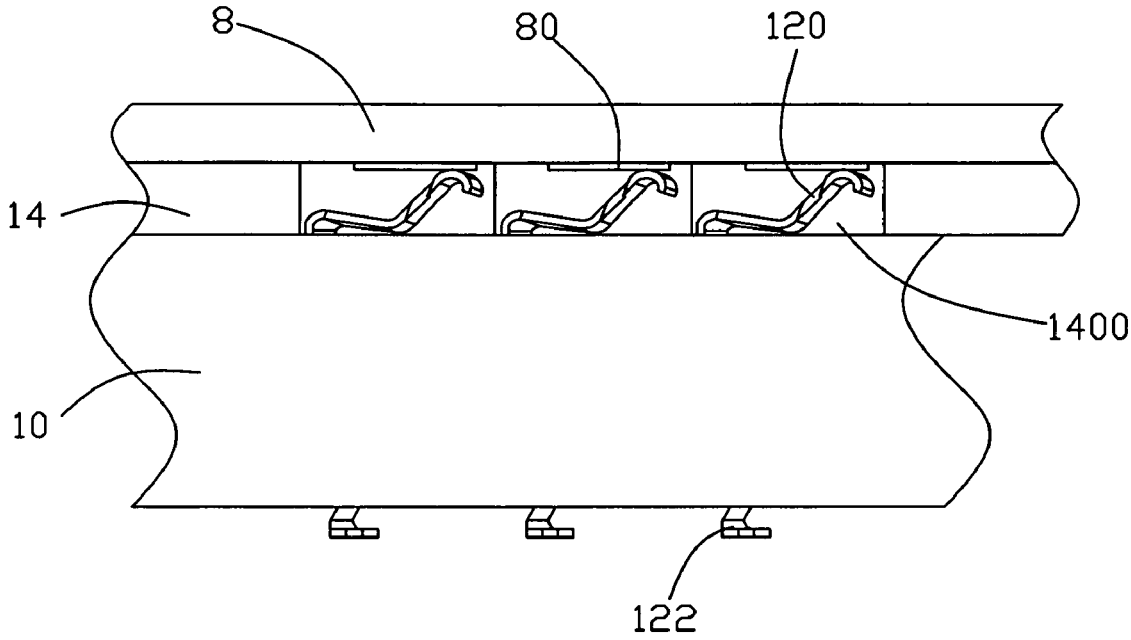
FIG. 7 is similar to the FIG. 6; however, the IC package is pushed toward the base and the contacts are deflected under a downward force.

Referring to FIG. 6, after the protective plate 14 is arranged on the base 10, the upper contacting portions 120 extend above the mating surface 102 but not above the through holes 1400 of the body portion 140 of the protective plate 14 before the IC package is pushed toward the base 10. Referring to FIG. 7, the upper engaging portions 120 can extend through the through holes 1400 of the body portion 140 to engage with pads 80 of the IC package 8. A contact engaging surface of the plurality of contacts 12 are arranged to be substantially flush with an upper surface of the floatable plate 14 in above compression process. By this way, contacts 12 will avoid being damaged when the IC package 8 is mounted on the electrical connector system 1.

Referring to FIGS. 8-12, an electrical connector system 2 according to a second preferred embodiment of the present invention is shown. The electrical connector system 2 comprises a base 20, a plurality of contacts 22 received in the base 20 and a protective plate 24 floatably arranged on the base 20.

The base 20 has a mounting surface 200 and a mating surface 202, and a plurality of passageways (not labeled) extending between the mating surface 202 and the mounting surface 200. The base 20 also has opposing perimeter walls 204 extending upwardly from peripheral edges of said base 20, and provides a substantially continuous contact-receiving surface between said perimeter walls 204. The perimeter walls 204 define a cavity therebetween above the contact-receiving surface. In another word, the continuous contact-receiving surface is entirely located in the mating surface 202.

The plurality of contacts 22 is arranged on the contact-receiving surface, and each is received in a passageway respectively. Each of the contacts 22 includes an upper contact engaging portion 220 extending above the mating surface 202 and a lower contact engaging portion 222 extending above the mounting surface 200.

Figure 10:
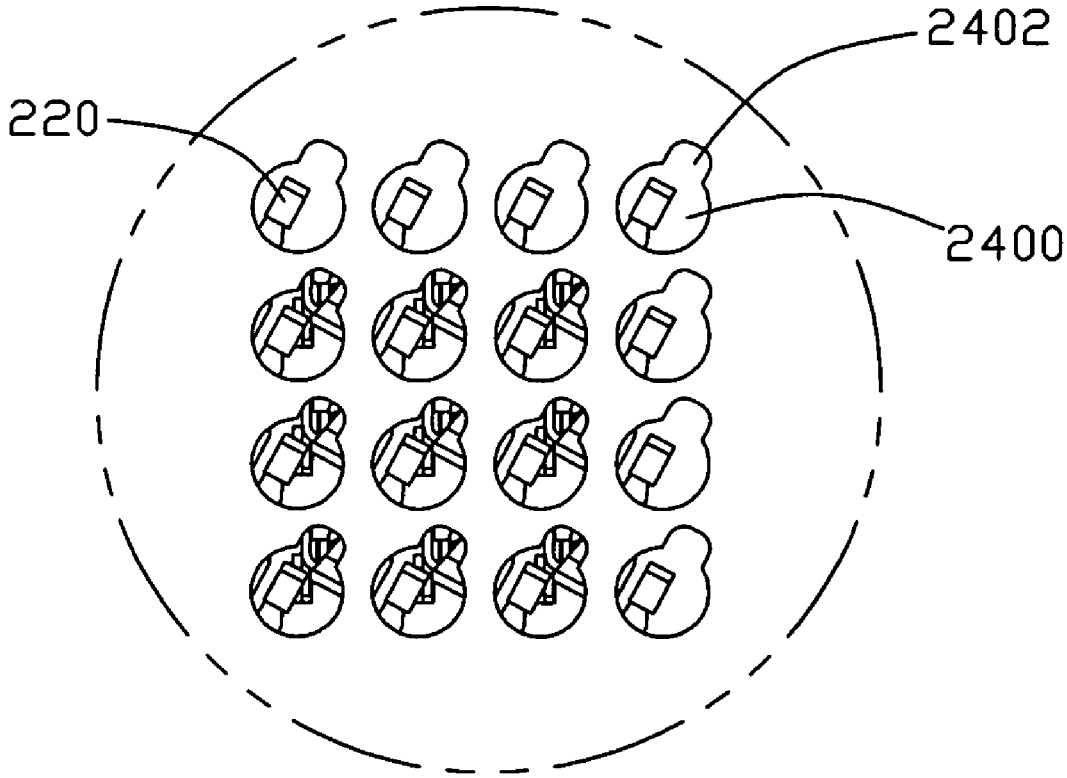
FIG. 10 is an enlarged perspective view of circled portion Y shown in FIG. 9.

The protective plate 24 is formed form plastic material and comprises a body portion 240 for substantially covering the upper contact engaging portions 220, and a plurality of flexible tabs 242 disposed on the body portion 240. The body portion 2140 defines a plurality of through holes 2400 correlated to the upper contact engaging portions 220. Referring to FIG. 10, each of the holes 2400 on the protective plate 24 further defines a notch 2402 for accommodating a tip of the upper contact engaging portion 220. The flexible tabs 242 are elevated higher than the surface of the body portion 240, which is also a main surface of the protective plate 24.

The flexible tabs 242 are located in each side of the body portion 240. Each of the flexible tabs 242 includes a main portion 2420 connecting with the body portion 240 and two spring legs 2422 extending from two opposite sides of the main portion 2420. The two spring legs 2422 extend substantially along corresponding side of the body portion 240. The flexible tabs 242 are formed integrally with the body portion 240 by inject art.

Figure 8:
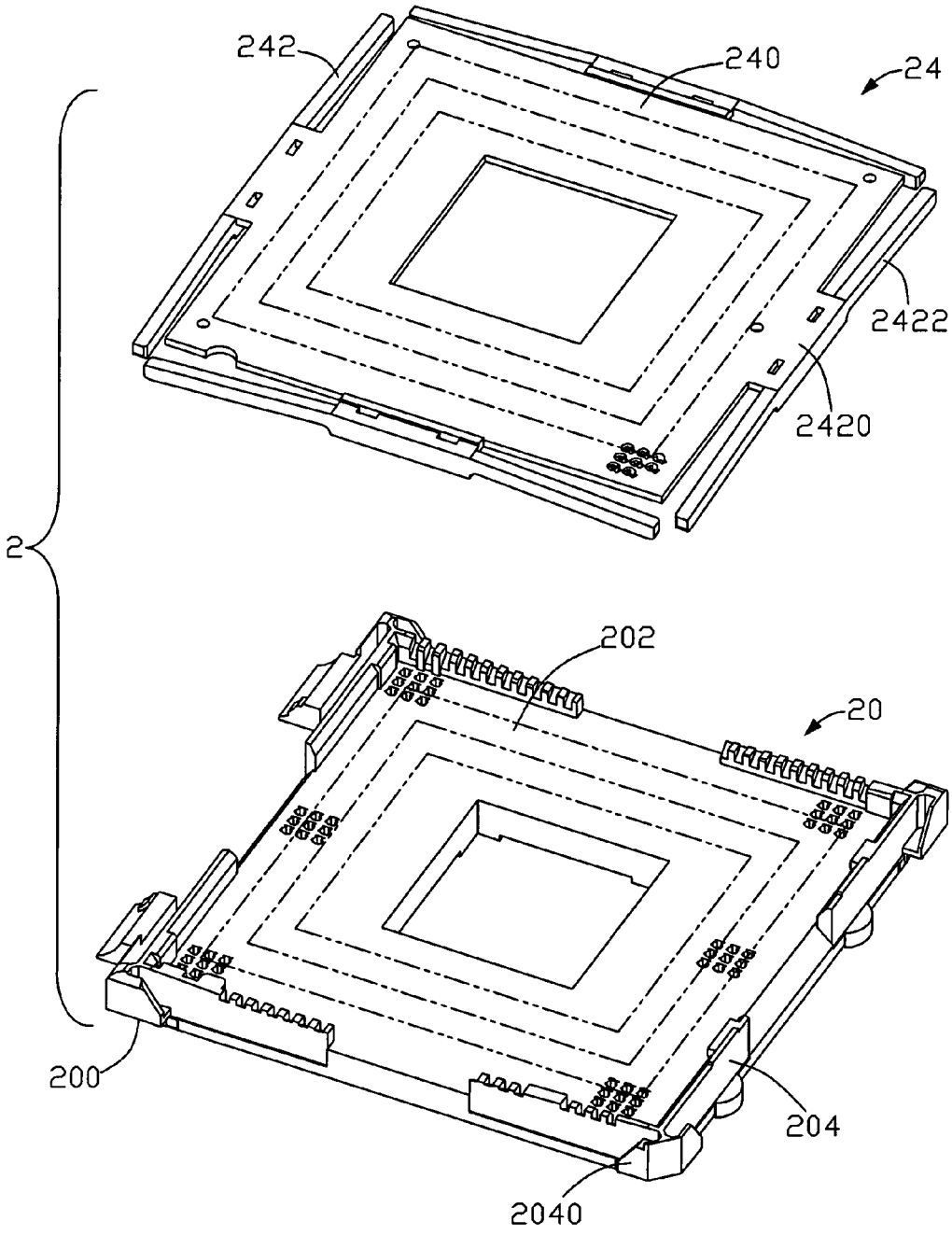
FIG. 8 is an exploded, perspective view of an electrical connector system in accordance with a preferred embodiment of the present invention.
Figure 9:
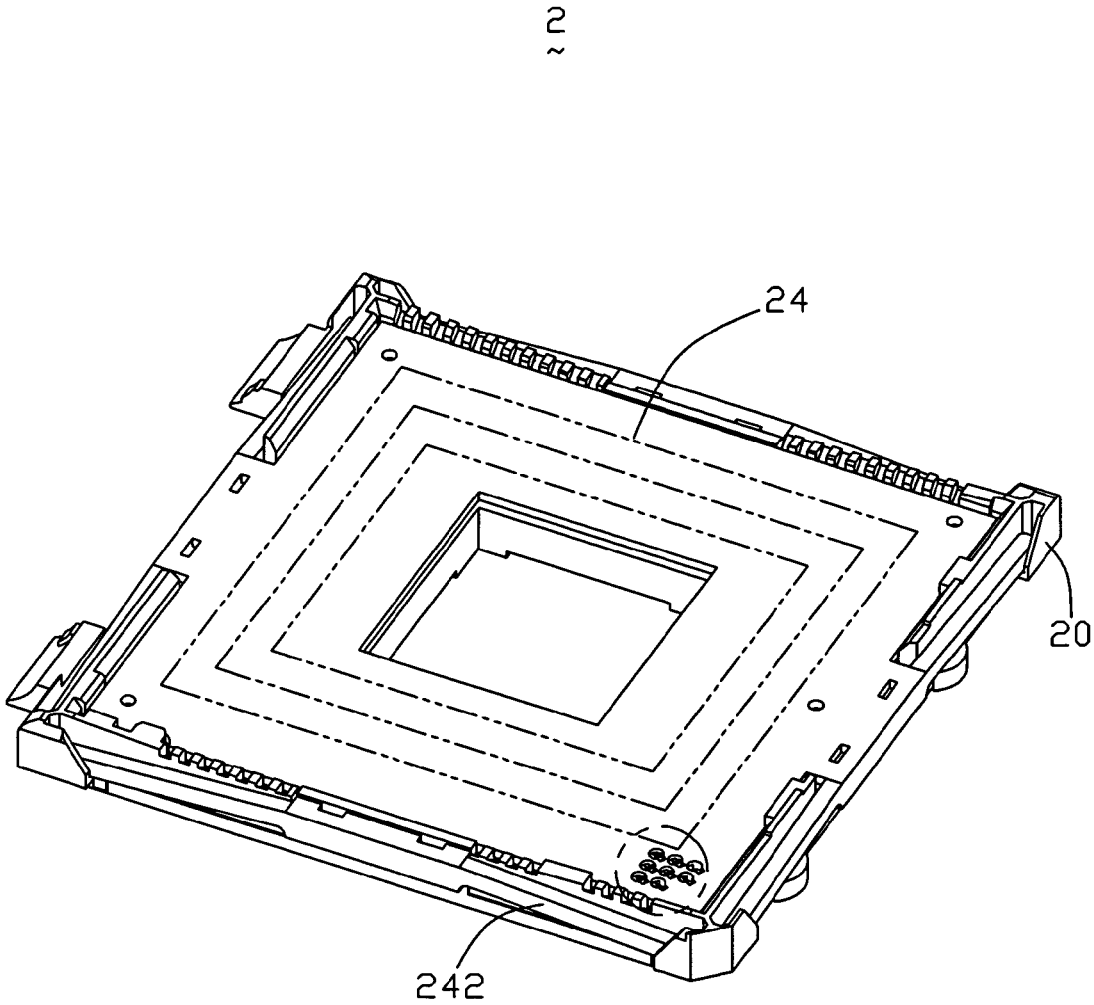
FIG. 9 is an assembled view of FIG. 8.

Referring to FIGS. 8-9, each of the perimeter walls 204 defines two positioning projects 2040 on opposite ends of an exterior side thereof. Each of the projects 2040 has a slantwise surface and a step disposed in a lower end of the slantwise surface. Two slantwise surfaces of the two projects 2040 on common exterior side of a perimeter wall 204 are opposite to each other.

In assembly, the protective plate 24 will be disposed on the base 20. End of the spring leg 2422 is guided by the slantwise surface until stopped by the step. By way above, the protective plate 24 is floatably arranged on exterior sides of the perimeter walls 204.

Figure 11:
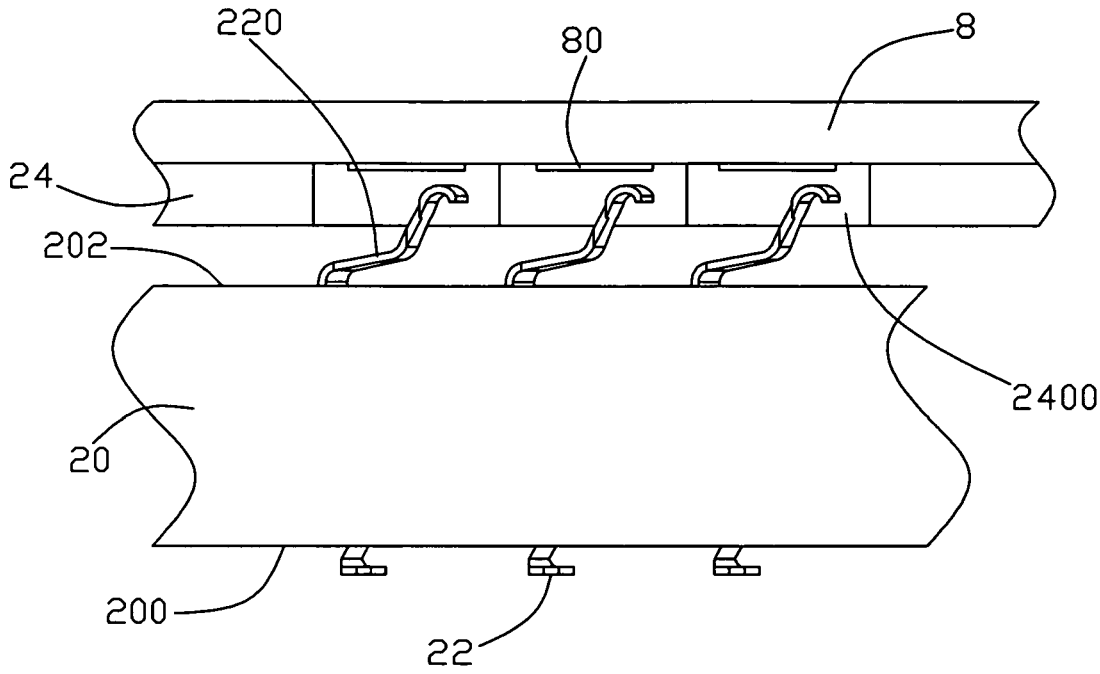
FIG. 11 is a side sketch view of the electrical connector system; especially an IC package is mounted upon the protective plate without pushed toward the base.
Figure 12:
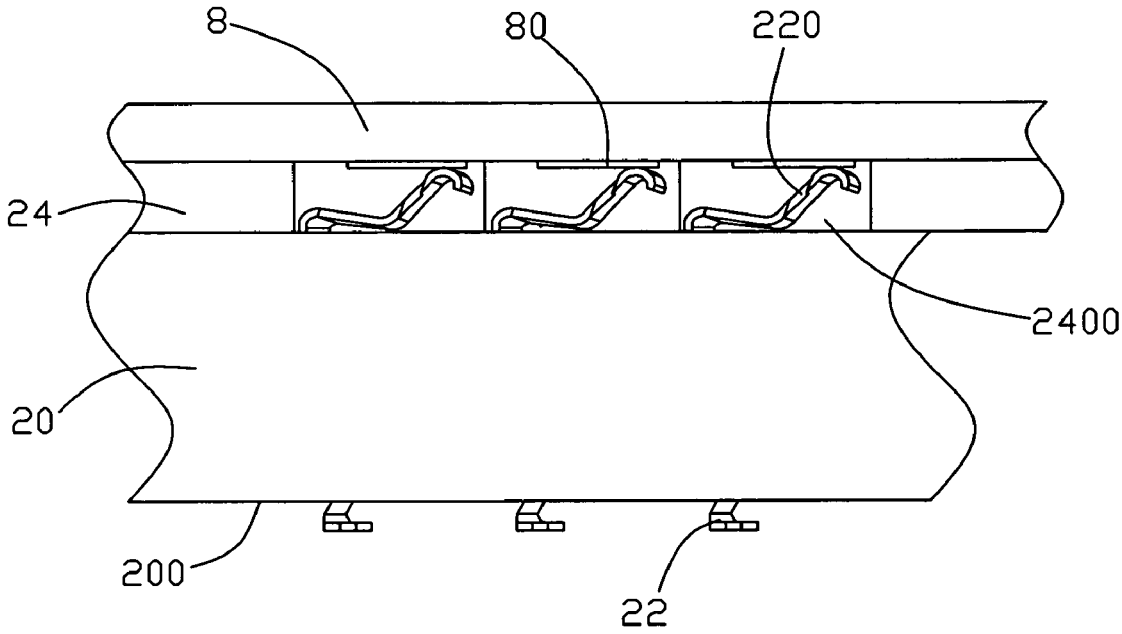
FIG. 12 is similar to the FIG. 11; however, the IC package is pushed toward the base and the contacts are deflected under a downward force.

Referring to FIG. 11, after the protective plate 24 is arranged on the base 20, the upper contacting portions 220 extend above the mating surface 2002 but not above the through holes 2400 of the body portion 240 of the protective plate 24 before the IC package 8 is pushed toward the base 20. Referring to FIG. 12, the upper engaging portions 220 can extend through the through holes 2400 of the body portion 240 to engage with pads 80 of the IC package 8. By this way, contacts will avoid being damaged when the IC package 8 is mounted on the electrical connector system 2.

Figure 13:
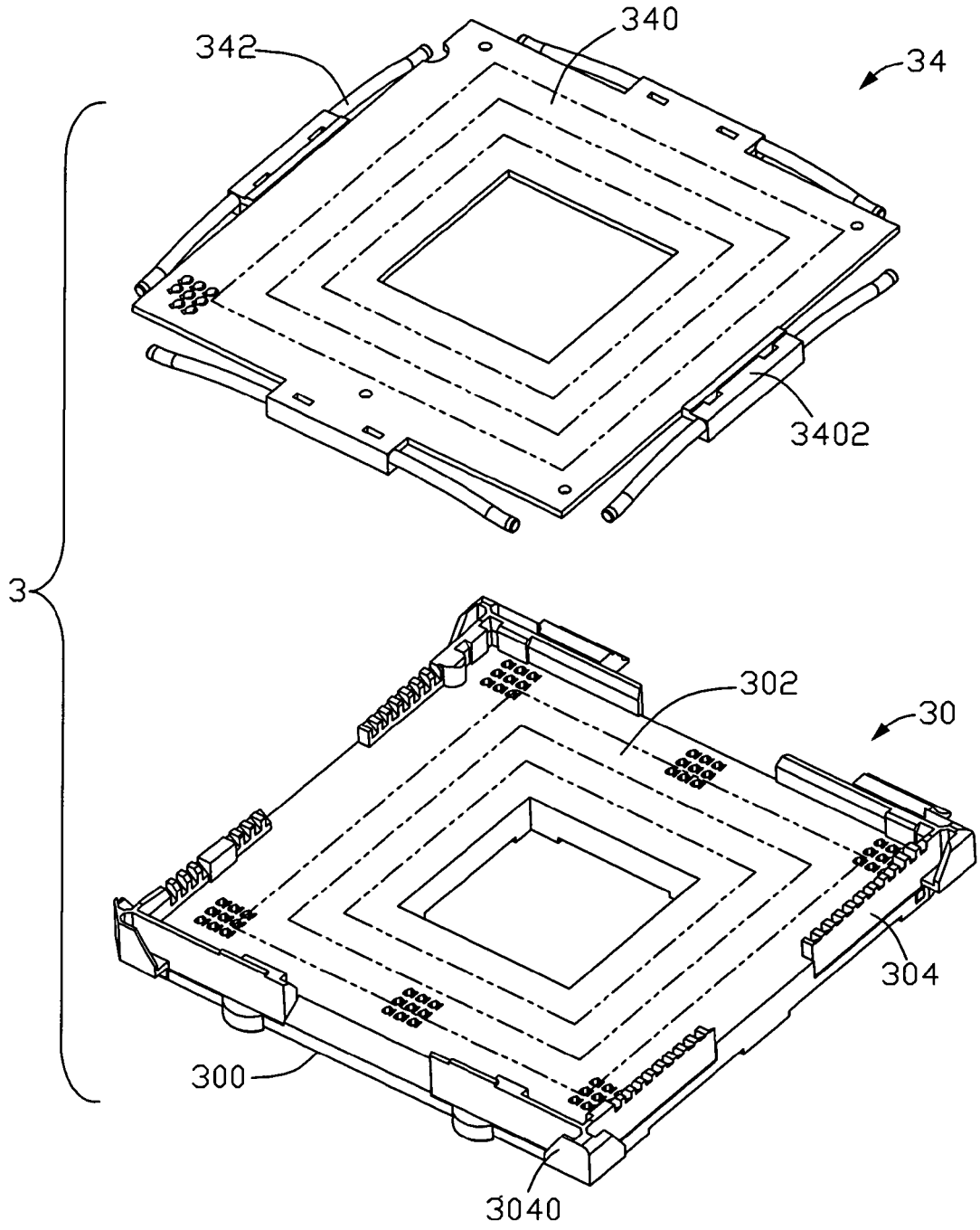
FIG. 13 is an exploded, perspective view of an electrical connector system in accordance with a preferred embodiment of the present invention.
Figure 14:
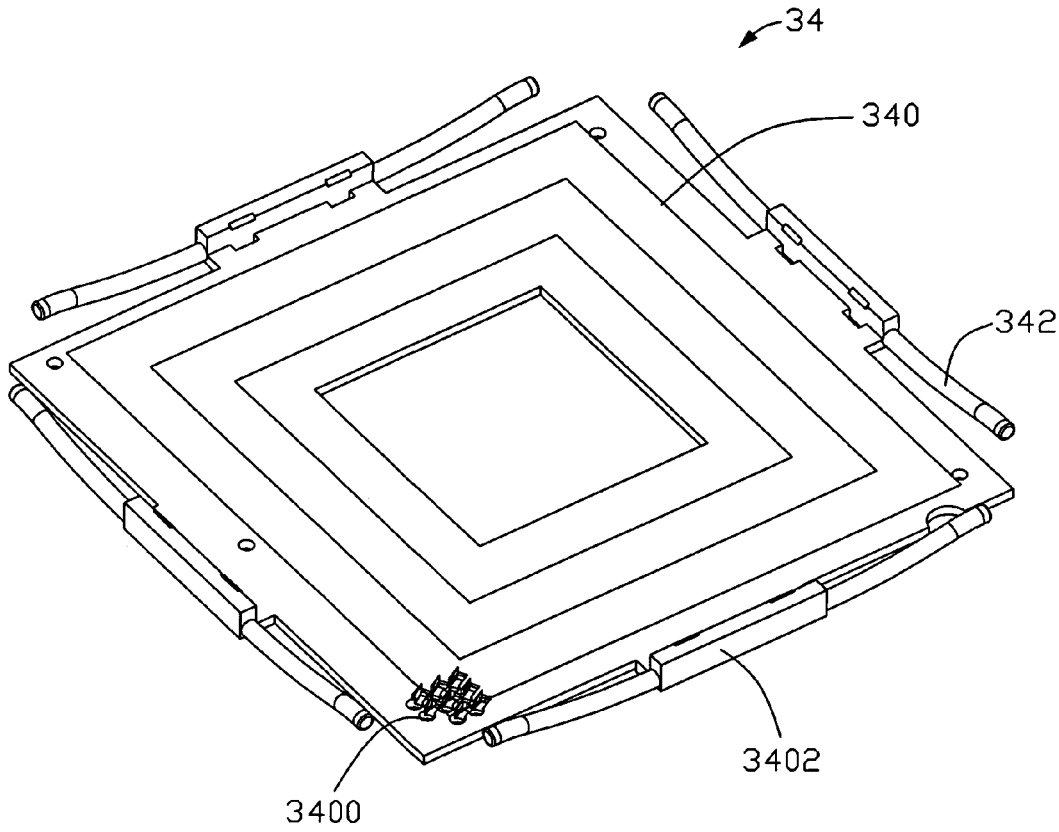
FIG. 14 is a perspective view of the protective plate of FIG. 13.
Figure 15:
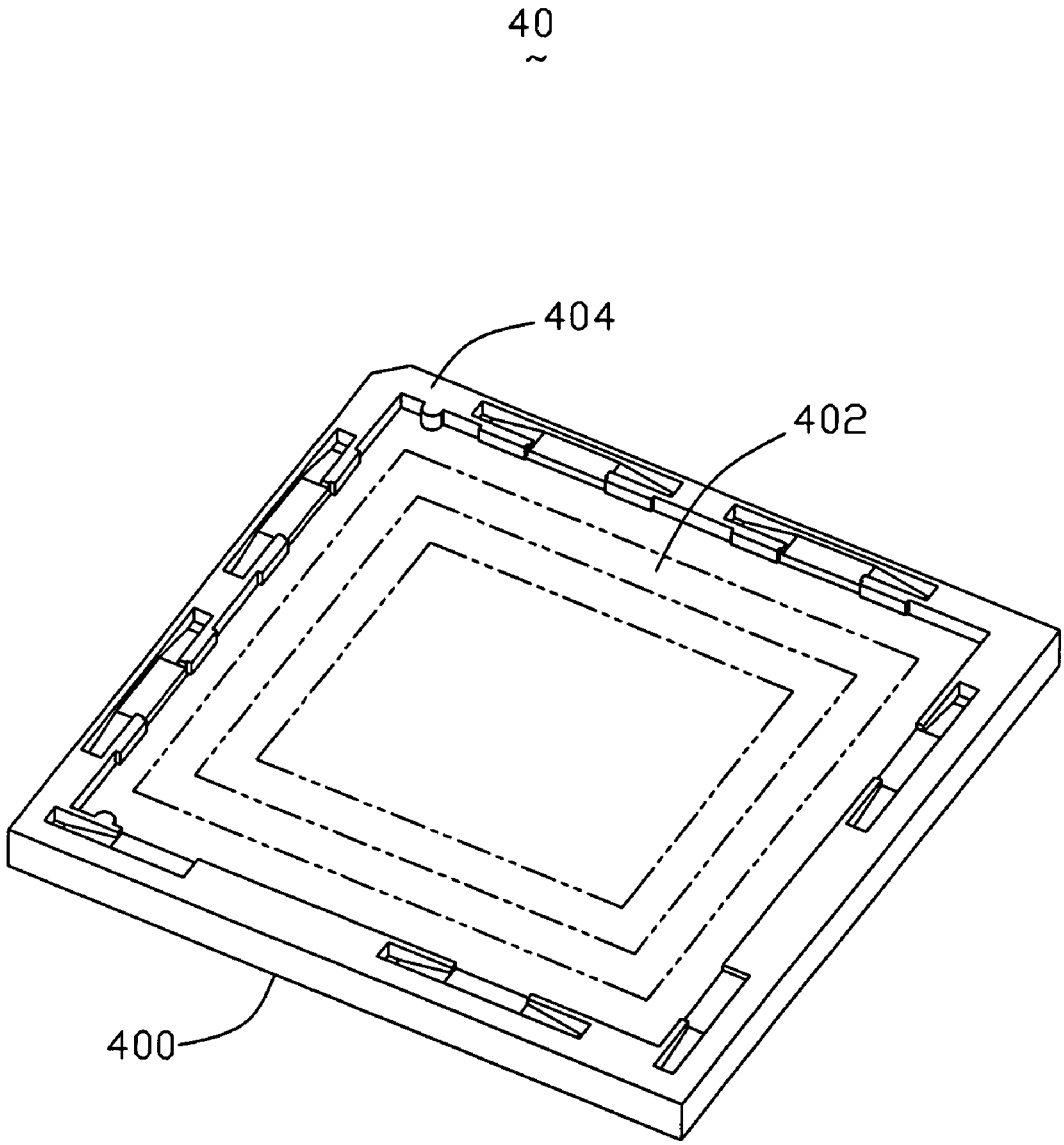
FIG. 15 is an assembled perspective view of an electrical connector system in accordance with a preferred embodiment of the present invention.
Figure 16:
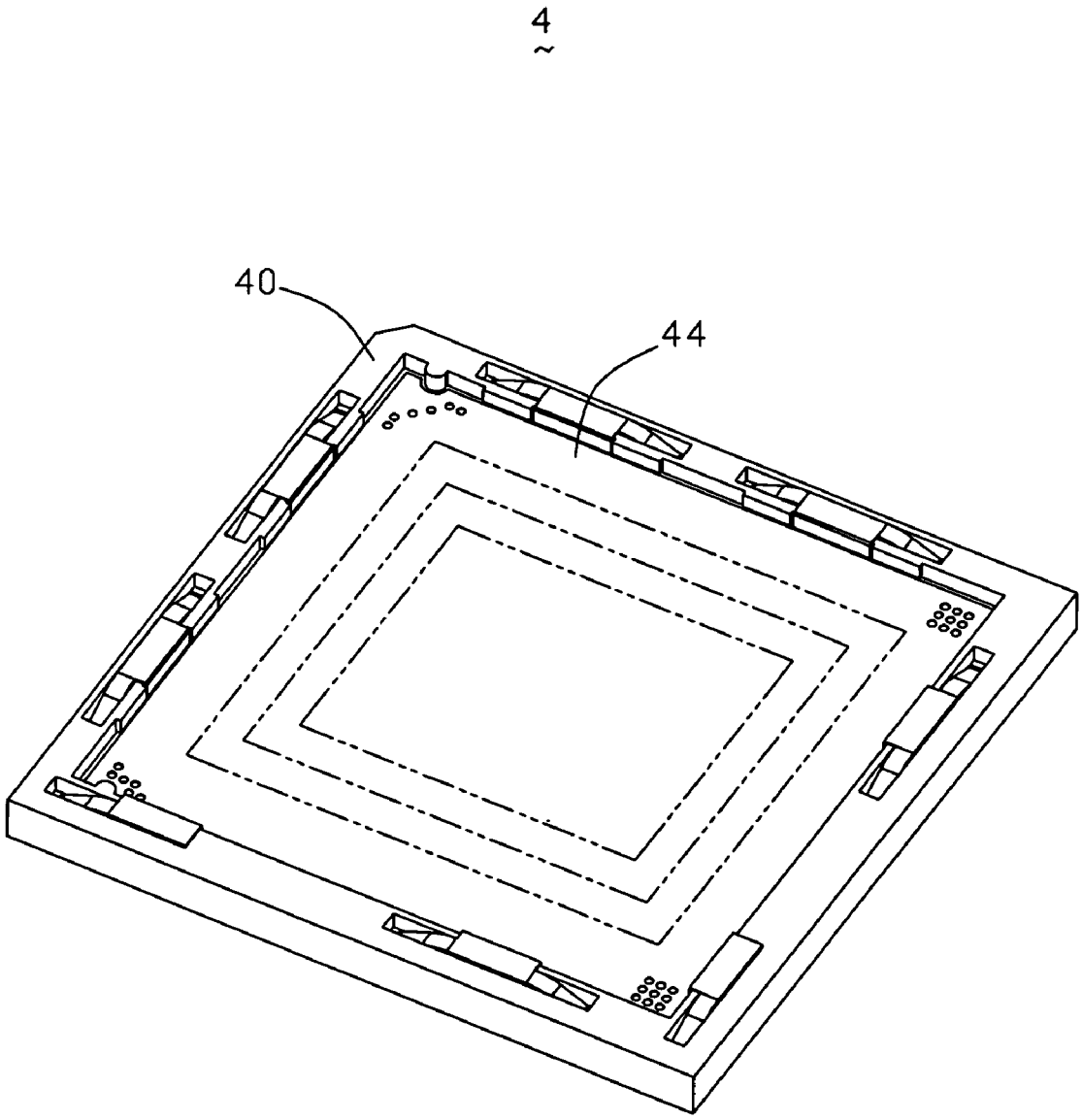
FIG. 16 is a perspective view of the base of the electrical connector system shown in FIG. 15.
Figure 17:
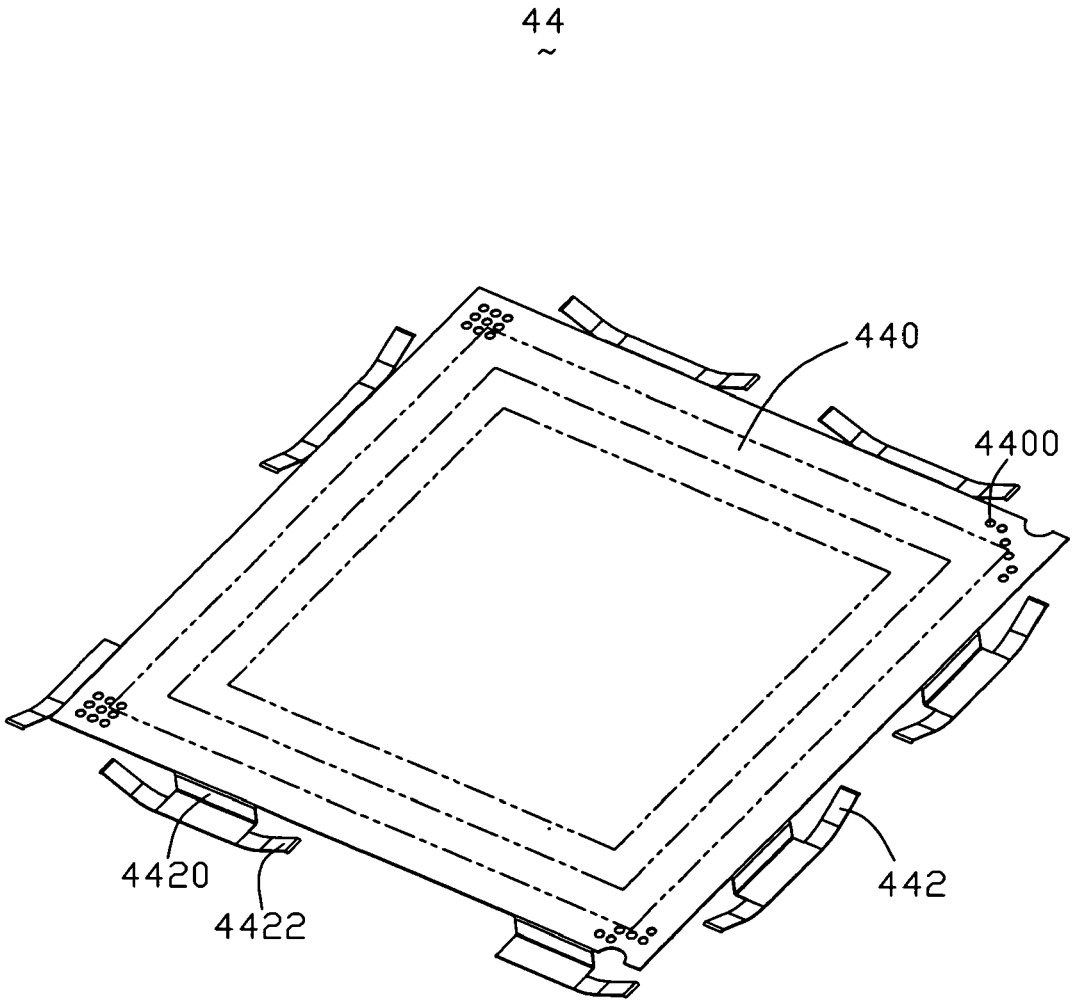
FIG. 17 is a perspective view of the protective plate of the present invention

Referring to FIGS. 13-14, electrical connector system 3 accordance with a third embodiment of the present invention is shown. The electrical system 3 is similarly to the electrical connector system 2. The electrical system 3 comprises a base 30 having opposing perimeter walls 304 extending upwardly from peripheral edges thereof, a plurality of contacts 32 received in the base 30, and a protective plate 34 arranged on the base 30.

Referring to FIGS. 13-14, each of the perimeter walls 304 defines two positioning projects 3040 on two opposite end of an exterior side thereof. Each of the projects 3040 has a slantwise surface and a step disposed in a lower end of the slantwise surface. Two slantwise surfaces of the two projects 3040 on common exterior side of a perimeter wall 304 are opposite to each other. The protective plate 34 comprises a body portion 340 formed from plastic material and a plurality of spring legs 342 made from metallic for attaching to the body portion 340. The body portion 340 defines a plurality of through holes 3400 correlated to the upper contact engaging portions (not shown). The body portion 340 is generally of a rectangular shape and has four sides. Each of the sides of the body portion 340 has a protrusion 3402 in the middle thereof. Each of the spring legs 342 is formed metallic wire and has a rounded section. The protrusion 3402 defines a hole (not shown) extending therethrough configured to have the spring leg 342 located therein.

As the electrical connector system 2, the protective plate 34 of the electrical connector system 3 will be mounted on the base 30 by spring legs 342 located on exterior sides of the perimeter walls 304. By this way, the contacts 32 will avoid being damaged when the IC package 8 is mounted on the electrical connector system 3.

Furthermore, because the protective plate is formed by a plastic body portion with a plurality of metallic spring legs disposed thereon, manufacture cost of the plastic is reduced.

Referring to FIGS. 15-19, according to a third preferred embodiment of the present invention, the electrical connector system 4 comprises a base 40, a plurality of contacts 42 received in the base 40 and two protective plates 44 floatably arranged on the base 40.

The base 40 has a mounting surface 400, a mating surface 402, and a plurality of passageways (not labeled) extending between the mating surface 402 and the mounting surface 400. The base 40 also has opposing perimeter walls 404 extending upwardly from peripheral edges of said base 40, and provides a substantially continuous contact-receiving surface between said perimeter walls 404. The perimeter walls 404 define a cavity (not labeled) therebetween above the contact-receiving surface. In another word, the continuous contact-receiving surface is entirely located in the mating surface 402.

The plurality of contacts 42 is arranged on the contact-receiving surface, and each is received in a passageway. Each of the contacts 42 includes an upper contact engaging portion 420 extending beyond the mating surface 402 and a lower contact engaging portion 422 extending out of the mounting surface 400. The upper contact engaging portion 420 is a resilient arm and like wise for the lower engaging portion 422.

Each of the protective plates 44 comprises a body portion 440, and a plurality of flexible tabs 442 disposed on the body portion 440.

The flexible tabs 442 are located in each side of the body portion 440. Each side of the body portion 440 defines two flexible tabs 442. Each of the flexible tabs 442 includes a main portion 4420 connecting with the body portion 440 and two spring legs 4422 extending from opposite sides of the main portion 4420. The body portion 440 defines a plurality of through holes 4400.

In this preferred embodiment, each of the perimeter walls 104 defines two recesses 4040 on a top portion for accommodating a flexible tab 442 respectively, and defines two recesses (not shown) on a bottom portion too. When the two protective plates 44 are assembled to the base 40, first one of the two protective plates 44 is floatably arranged on the base 40 from side of the mating surface 402, and second one is floatably arranged on the base 40 from side of the mounting surface 400.

Figure 18:
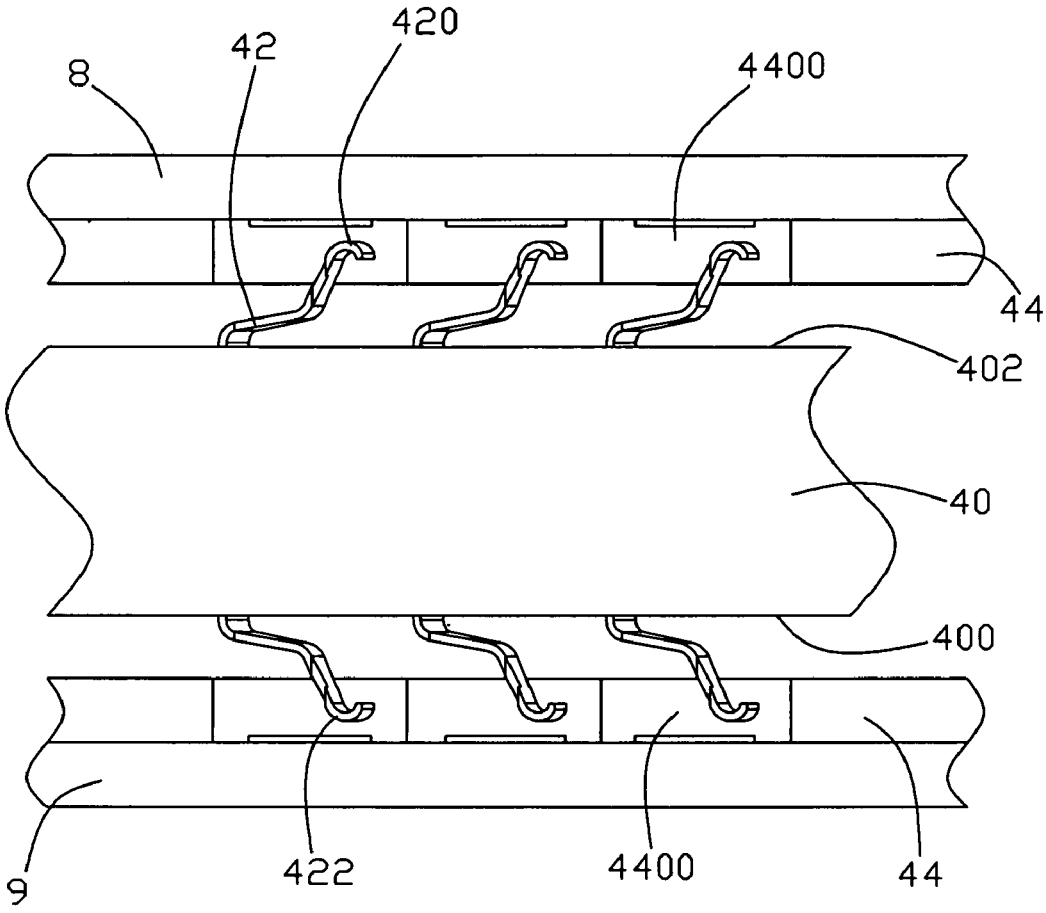
FIG. 18 is a side sketch view of the electrical connector system; especially an IC package is mounted upon the protective plate without pushed toward the base.
Figure 19:
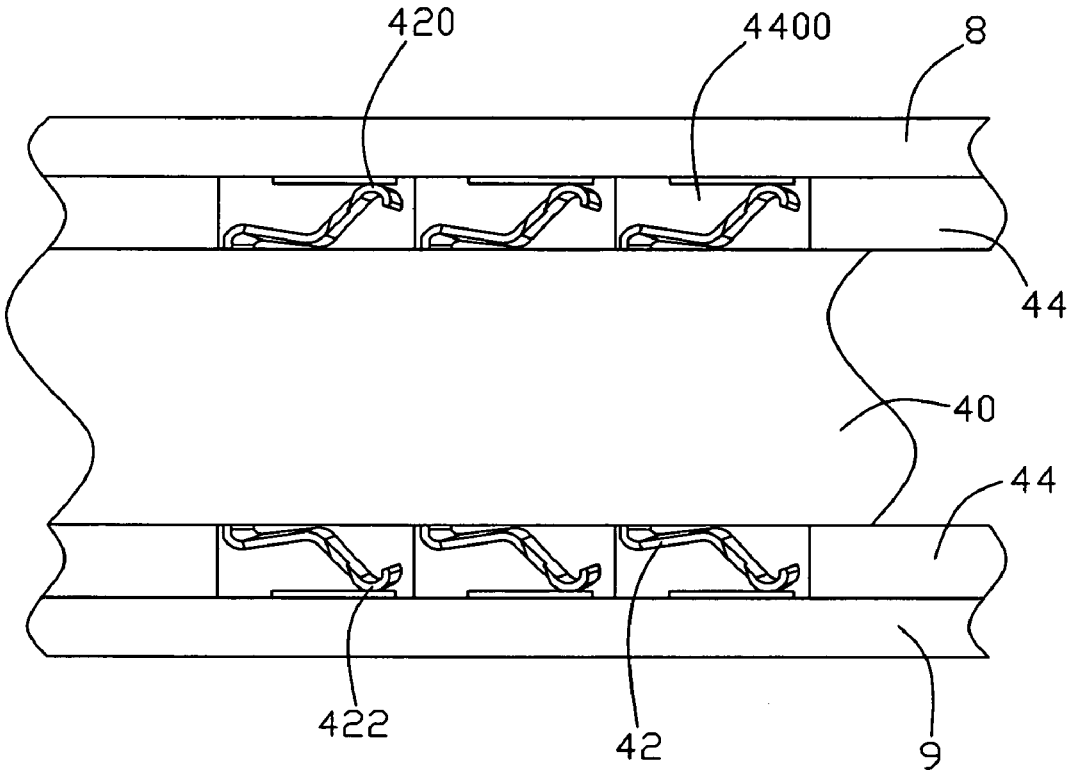
FIG. 19 is similar to the FIG. 17; however, the IC package is pushed toward the base and the contacts are deflected under a downward force.

Referring to FIGS. 18-19, body portion 440 of the first one of the two protective plates 40 is substantially covering the upper contact engaging portions 420, and the plurality of holes 4400 are correlated to the upper contact engaging portions 420 such that the upper contact engaging portion 420 can extend through the hole 4400 when the plate 44 is pushed toward the base 40. Similarly, body portion 440 of the second one of the two protective plates 40 is substantially covering the lower contact engaging portions 422, and the plurality of holes 4400 are correlated to the lower contact engaging portions 420 such that the lower contact engaging portion 422 can extend through the through hole 4400 when the plate 44 is pushed toward the base 40. The lower contact engaging portion 420 extends through the through holes 4400 for engaging conductive pad (not labeled) of a PCB 9. By this way, contacts 42 will avoid being damaged when the IC package 8 is mounted on the electrical connector system 4 that will be mounted on the PCB 9.

Although the present invention has been described with reference to the accompanying drawings, it is not to be construed as being limited thereto. Various alterations and modifications can be made to the embodiments without in any way departing from the scope or spirit of the present invention as defined in the appended claims. Such modifications and alterations that may be apparent to a person skilled in the art are intended to be included within the scope of this invention as defined in by the accompanying claims. For example, in some circumferences, when the contacts are densely arranged among the base, and the deflectable contact arms of the neighboring contacts, which extend above an upper surface of the base, are inevitably overlapped with one another among the adjacent contacts, it is impossible to have an undersurface of the protective plate intimately seated upon an upper surface of the contact area of the base while still keeping the discrete holes in the protective plate. In other words, the undersurface of the protective plate should be spaced from the upper surface of the contact area of the base with a gap via provision of standoffs along a peripheral region so as to allow the discrete holes to respectively receive the uppermost contact ends of the contacts which are not overlapped with one another. Understandably, if there is no such a gap, it is impossible to have the discrete holes in the protective plate but requiring to integrating the lined through holes into an elongated slot for receiving the contacting ends and the overlapped deflectable contact arms of the lined contacts.

What is claimed is:

1. An electrical connector system comprising:

a base with opposing perimeter walls extending upwardly from peripheral edges of said base, and providing a substantially continuous contact-receiving surface between said perimeter walls, said perimeter walls defining a cavity therebetween above the contact receiving surface;

a plurality of contacts arranged on the contact receiving surface, and each including a contact engaging portion extending above the contact receiving surface;

a protective plate floatably arranged on the perimeter walls of the base and substantially above the contact engaging portions, and having a plurality of holes correlated to the contact engaging portions such that the contact engaging portion can extend through the hole when the plate is pushed toward the base, and contact engaging surfaces of the plurality of contacts are arranged to be substantially flush with an upper surface of the floatable plate in above compression process; and flexible tabs are located in each side of a body portion of the protective plate, wherein each of the flexible tabs includes a main portion connecting with the body portion and two spring legs extending from two opposite sides of the main portion, and wherein the two spring legs extend substantially along corresponding side of the body portion.

2. The electrical connector system as claimed in claim 1, wherein each of the holes on the protective plate is further defined with a notch in accommodating a tip of the contact engaging portion.

3. The electrical connector system as claimed in claim 1, wherein the protective plate is floatably arranged on sides of the perimeter walls of the base.

4. An electrical connector system comprising:

a base with mating surface and a mounting surface, and defining a plurality of passageways extending between the mating surface and the mounting surface a plurality of contacts arranged in the corresponding passageways, and each including an upper contact engaging portion extending above the mating surface, and a lower contact engaging portion extending beyond the mounting surface; and a protective plate arranged on the base, comprising:

a body portion substantially above the upper contact engaging portions and having a plurality of holes corresponding to the upper contact engaging portions such that the contact engaging portion can extend through the hole when the plate is pushed toward the base;

a plurality of flexible tabs disposed in sides of the body portion; and wherein the base defines a plurality of receiving portions to accommodate the plurality of flexible tabs respectively such that the protective is movable relative to the base when the plate is pushed toward the base;

wherein each of the flexible tabs includes a main portion connecting with the body portion and two spring legs extending from two opposite sides of the main portion, and wherein the two spring legs extend substantially along corresponding side of the body portion.

5. The electrical connector system as claimed in claim 4, wherein the base has perimeter walls extending upwardly and surrounding the plurality of passageways.

6. The electrical connector system as claimed in claim 5, wherein the plurality of flexible tabs is floatably arranged on exterior sides of the perimeter walls of the base.

7. The electrical connector system as claimed in claim 6, wherein the exterior sides of the perimeter walls have two positioning projections on two opposite ends thereof.

8. An electrical connector comprising:

an insulative base including a central contact region and a periphery region;

a plurality of contacts disposed in the central contact region with contacting ends upwardly extending from corresponding deflectable contact arms and above an upper face of the contact region;

a protective plate up and down floating mounted upon the base via a plurality of resilient devices located along said periphery region; and a plurality of discrete through holes formed in the protective plate;

wherein said deflectable arms of the neighboring contacts are not overlapped with one another while being exposed above the upper surface of the central contact region under condition that an undersurface of the protective plate is spaced from the upper surface of the central contact region with a gap and each of the discrete holes only receives the corresponding contacting end without the associate deflectable contact arm; and wherein said resilient devices are located in each side of a body portion of the protective plate and each of the resilient devices includes a main portion connecting with the body portion and two spring legs extending from two opposite sides of the main portion, and wherein the two spring legs extend substantially along corresponding side of the body portion.

9. The electrical connector as claimed in claim 8, wherein said resilient devices are integrally or unitarily formed with said protective plate.

10. The electrical connector as claimed in claim 9, wherein the base defines a plurality of receiving portions along said periphery region to respectively accommodate the corresponding resilient devices.

11. The electrical connector as claimed in claim 8, wherein the discrete holes are arranged in columns and rows perpendicular to each other while the deflectable arm extends along an oblique direction oblique to column and row directions respectively defined by said columns and said rows in a top view, and said deflectable arm is essentially aligned, along the oblique direction, with another deflectable arm of the corresponding contact under condition that the corresponding discrete hole of said deflectable is spaced from that of another deflectable arm with one column and two rows.

* * * * *